US007503640B2

(12) United States Patent
Sugahara et al.

(10) Patent No.: US 7,503,640 B2
(45) Date of Patent: Mar. 17, 2009

(54) INK-JET HEAD AND INK-JET PRINTER

(75) Inventors: Hiroto Sugahara, Aichi-ken (JP); Fumihiro Minamizawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/536,154

(22) Filed: Sep. 28, 2006

(65) Prior Publication Data

US 2007/0076050 A1 Apr. 5, 2007

(30) Foreign Application Priority Data

Sep. 30, 2005 (JP) ..... 2005-286229

(51) Int. Cl.
*B41J 2/15* (2006.01)
*B41J 2/21* (2006.01)

(52) U.S. Cl. ..... 347/40; 347/15; 347/17; 347/43; 347/54; 347/68; 29/890.1; 29/25.35; 239/690

(58) Field of Classification Search ..... 347/40, 347/43, 3, 33
See application file for complete search history.

(56) References Cited

U.S. PATENT DOCUMENTS 6,024,431 A 2/2000 Takahashi et al.
6,084,621 A 7/2000 Shioya
6,120,141 A 9/2000 Tajika et al.
6,142,619 A 11/2000 Miura et al.
6,286,926 B1 * 9/2001 Hirabayashi et al. ..... 347/17
6,312,121 B1 11/2001 Smith et al.
6,334,666 B1 * 1/2002 Inui et al. ..... 347/43
6,439,708 B1 8/2002 Kato et al.
6,547,380 B2 4/2003 Smith et al.
6,742,866 B2 * 6/2004 Anderson et al. ..... 347/40
6,827,423 B1 12/2004 Katakura et al.
6,896,348 B2 * 5/2005 Takekoshi et al. ..... 347/15
2002/0024549 A1 2/2002 Miura et al.
2002/0060716 A1 * 5/2002 Kato et al. ..... 347/43
2003/0202026 A1 10/2003 Smith et al.
2003/0202045 A1 * 10/2003 Torgerson et al. ..... 347/43
2004/0239722 A1 * 12/2004 Otsuki ..... 347/40

(Continued)

FOREIGN PATENT DOCUMENTS

EP 0985538 A2 3/2000

(Continued)

OTHER PUBLICATIONS

European Patent Office; European Search Report for Related EP Application No. 06020313.0, dated Jan. 22, 2007.

*Primary Examiner*—Matthew Luu
*Assistant Examiner*—John P Zimmermann
(74) *Attorney, Agent, or Firm*—Baker Botts L.L.P.

(57) ABSTRACT

An ink-jet head includes a nozzle row which jets a black ink, and nozzle rows which jet color inks, and a nozzle row which jets a special color ink. These nozzle rows are arranged in a scanning direction, and further, the nozzle row jetting the special color ink is positioned at an extreme end with respect to the scanning direction. Accordingly, it is possible to realize a small size printer which is capable of jetting the special color ink. Furthermore, it is possible to suppress the special color ink from getting mixed into a nozzle which jets an ink of other type.

8 Claims, 13 Drawing Sheets

U.S. PATENT DOCUMENTS

| | | | | |
|---|---|---|---|---|
| 2005/0001878 | A1* | 1/2005 | Yamasaki et al. | 347/43 |
| 2005/0157067 | A1* | 7/2005 | Hoshino | 347/43 |
| 2005/0243126 | A1* | 11/2005 | Takahashi et al. | 347/40 |
| 2006/0071968 | A1* | 4/2006 | Kawase | 347/40 |
| 2006/0103691 | A1* | 5/2006 | Dietl et al. | 347/40 |
| 2008/0018703 | A1* | 1/2008 | Nakano et al. | 347/43 |

FOREIGN PATENT DOCUMENTS

| | | | |
|---|---|---|---|
| EP | 1022151 | A1 | 7/2000 |
| JP | 1994246909 | A | 6/1994 |
| JP | 1998128963 | A | 5/1998 |
| JP | 2002011872 | A | 1/2002 |
| JP | 2002292849 | A | 10/2002 |

* cited by examiner

INK-JET HEAD AND INK-JET PRINTER

CROSS REFERENCE TO RELATED APPLICATION

The present application claims priority from Japanese Patent Application No. 2005-286229, filed on Sep. 30, 2005, the disclosure of which is incorporated herein by reference in its entirely.

BACKGROUND OF THE INVENTION

1. Field of the Invention

The present invention relates to an ink-jet head which jets an ink on to a recording medium, and an ink-jet printer.

2. Description of the Related Art

A color ink-jet printer which records a color image by jetting inks of plurality of colors onto a recording medium includes an ink-jet printer which is capable of jetting a black ink and a color ink and which has hitherto been use, and an ink-jet printer which is capable of jetting inks other than black and color inks. For example, an ink-jet printer which is capable of jetting a special color ink (for example, gold and silver ink, white ink, transparent ink, a fluorescent ink, or the like) which does not contribute to full color printing, is available. Ink-jet printers described in U.S. patent applications Nos. 6024431, 6142619, and 2002024549A1 (correspond to Japanese Patent Application Laid-open No. H6-246909), include a plurality of recording heads (ink-jet heads) mounted on one holder which is capable of moving in a predetermined direction, and each of these recording heads includes nozzles which jet an extended-color ink such as a light color ink, a color ink, black ink and a special color ink. Moreover, the recording heads are arranged (lined up) in a direction of movement of the head holder (scanning direction) in an order of a recording head for the color ink, a recording head for the black ink, a recording head for special color ink, and a recording head for the extended-color ink.

SUMMARY OF THE INVENTION

However, since a recording head for a special color ink, in addition to a recording head for a black ink and a recording head for a color ink, is mounted on one head holder, a length of the head holder in a scanning direction becomes long, and this increase in the length of the recording head leads to an increase in a size of an overall printer. Moreover, since the recording head for the special color ink is positioned between the recording head for the black ink and a recording head for an extended-ink, the special color ink jetted from the head for the special color ink easily makes inflow into other nozzles positioned at both sides of the recording head. Particularly, when a purge operation is performed by a maintenance mechanism, since a large amount of ink which is sucked is adhered to an ink jetting surface of an ink-jet head, a possibility of the special color ink flowing into the nozzles for other colors is high. In a case in which the special color ink has a poor dispersibility, such as a gold ink, a silver ink, or a white ink which includes fine particles having a high specific gravity, when the special color ink is flowed into a nozzle which jets an ink of other type, there is a possibility that a precipitate is generated inside the nozzle, which may lead to a jetting defect such as blocking of the nozzle etc., in a nozzle which jets an ink other than the special color ink. Or, when a special color ink such as a magnetic ink, and an ink which emits fluorescent light upon reacting to ultraviolet rays is flowed into a nozzle jetting other ink, and is mixed with the other ink, it leads to a major problem when an image formed of the special color ink printed on a recording medium is to be detected by an appropriate device. Normally, an image printed by such special color inks cannot be checked visually, but can be read by a special device. In this case, when these special color inks are jetted upon being mixed with an ink of other color, an image is formed by the special color ink at a place where it is not anticipated to be formed, and becomes a problem.

An object of the present invention is to provide an ink-jet head and an ink-jet printer which are capable of jetting the special color ink, and reducing a size of a printer, and further, capable of suppressing mixing of the special color ink in a nozzle which jets an ink of other type.

According to a first aspect of the present invention, there is provided an ink-jet head which jets an ink, comprising:

a first nozzle row including a plurality of first nozzles which are arranged in a first direction and which jet a black ink;

a second nozzle row including a plurality of second nozzles which are arranged in the first direction and which jet a color ink contributing to a full color printing; and a third nozzle row including a plurality of third nozzles which are arranged in the first direction and which jet a special color ink which is an ink other than the black ink and the color ink.

The first nozzle row, the second nozzle row, and the third nozzle row are aligned in a second direction which intersects with the first direction, and the third nozzle row is arranged at an end with respect to the second direction.

In this case, since the ink-jet head includes the first nozzle row which jets the black ink, the second nozzle row which jets the color ink, and the third nozzle row which jets the special color ink, it is possible to jet by one ink-jet head, the special color ink which does not contribute to a full color printing, in addition to the black ink and the color ink. Consequently, it is possible to deal with a printing of various images. Here, as the special color ink, for example, inks which do not contribute to a full color printing such as an ink which diffuses an aroma, or a gold ink and a silver ink, a white ink, a transparent ink, and a fluorescent ink, and special inks which react to ultraviolet rays and magnetism, are appropriate. Light color inks which contribute to the full color printing, such as light cyan and light magenta are not included in the special color inks. Moreover, since it is possible to narrow an interval between rows of nozzles, as compared to a case in which a recording head is provided for each type of ink, it is possible to reduce a size of the overall printer.

Moreover, since the third nozzle row which jets the special color ink is positioned at an extreme end with respect to the second direction, it is possible to suppress an occurrence of a jetting defect in a nozzle caused due to flowing of the special color ink into a nozzle which jets an ink of other type. Here, even when the second nozzle row for jetting the color ink jets a light color ink, the third nozzle row which jets the special color ink is positioned at the extreme end with respect to the second direction. On the other hand, since the first nozzle row which jet the black ink and the second nozzle row which jet the color ink come near, a landing position of the black ink and the color ink is hardly shifted at the time of full color printing, and a printing quality is improved.

In the ink-jet head of the present invention, the third nozzle row may be positioned next to the first nozzle row. When the black ink is let to be jetted not only from the first nozzles which jet the black ink, but also from the third nozzles in the third nozzle row, instead of the special color ink, the number of nozzles jetting the black ink is increased. Consequently, it is possible to increase a printing speed than a speed in a case of performing monochrome printing by only the first nozzles. Since the third nozzle row is positioned adjacent to the first nozzle row which jet the black ink, it is possible to supply easily the black ink to both the first nozzles and the third nozzles.

In the ink-jet head in the present invention, the first nozzles, the second nozzles, and the third nozzles may be arranged in the first direction at a same pitch P, and the third nozzles may be arranged to be shifted by P/2 in the first direction, with respect to the first nozzles. When the black ink is let to be jetted not only from the first nozzles jetting the black ink, but also from third nozzles instead of special color ink, since a pitch of these nozzles jetting the black ink, with respect to the first direction, is ½ of the pitch P of the first nozzles included in the first nozzle row, the printing speed becomes even faster than in the case of performing the monochrome printing by only the first nozzles.

In the ink-jet head of the present invention, the first nozzles and the second nozzles may be positioned at same positions with respect to the first direction. In this case, since a difference in a landing time of the black ink and the color ink which land on a recording medium during a color printing becomes small, the unevenness in colors is suppressed.

In the ink-jet head of the present invention, the first direction may be orthogonal to the second direction. In this case, it is possible to suppress to a substantial extent an increase in a length of the ink-jet head with respect to the second direction, which is caused due to providing the third nozzle row which jet the special color ink.

In the ink-jet head of the present invention, the first nozzle row may include two first nozzle sub arrays each having a predetermined number of the first nozzles arranged in the first direction at the pitch P, and the two first nozzle sub arrays may be positioned to be mutually shifted by P/2, in the first direction; the second nozzle row may include a plurality of second nozzle sub arrays each having the predetermined number of the second nozzles arranged in the first direction at the pitch P, the second nozzles belonging to each of the second nozzle sub arrays may be positioned at a same position with respect to the first direction, and the color ink may include a plurality of sub color inks which are mutually different in color and each of which is jetted from second nozzles belonging to one of the second nozzle sub arrays;

the third nozzle row may include two third nozzle sub arrays having a predetermined number of third nozzles arranged in the first direction at the pitch P, and the two third nozzle sub arrays may be positioned to be mutually shifted by P/2, in the first direction, and the two third nozzle sub arrays may be positioned to be shifted only by P/4 in the first direction, with respect to the first nozzle sub array; and the first nozzle row, the second nozzle row, and the third nozzle row may be aligned in the second direction which intersects with the first direction, and the third nozzle row may be positioned at a farthermost end with respect to the second direction.

In this case, an interval between the nozzles (a pitch of the nozzles) with respect to the first direction of the first nozzle row which jets the black ink, and the third nozzle row which jets the special color ink is ½ of the pitch P of each row of nozzle. Therefore, the printing speed at the time of performing the printing by the black ink and the special color ink is increased. Furthermore, when the black ink is let to be jetted instead of the special color ink from the third nozzle row, the pitch of the nozzles jetting the black ink becomes ¼ of the pitch P of each row of nozzle, and the printing speed at the time of monochrome printing is increased further.

In the ink-jet head of the present invention, the special color ink may be an ink which is selected from a group consisting of a gold ink, a silver ink, a white ink, a transparent ink, an aromatic ink, a fluorescent ink, an ultraviolet fluorescent ink, and a magnetic ink. In this case, it is possible to use ink having various characteristics, and to perform a wide variety of printing. The aromatic ink is an ink which exhales an odor, and the ultraviolet fluorescent ink is an ink which reacts to ultraviolet rays and emits fluorescence. Moreover, the magnetic ink is an ink which includes a powder of a magnetic material, and reacts to a magnetic field.

According to a second aspect of the present invention, an ink-jet printer which includes the ink-jet head of the present invention is provided. According to the second aspect of the present invention, it is possible jet further from one ink-jet head, the special color ink which does not contribute to the color printing, in addition to the black ink and the color ink. Therefore, the ink-jet printer of the present invention is capable to deal with printing of various images. Moreover, as compared to a case in which recording heads are provided according to the type of ink, it is possible to reduce the size of the printer by narrowing an interval between rows of nozzles.

In the ink-jet printer of the present invention, the ink-jet head may include an ink jetting surface in which ejecting ports of the first nozzles, the second nozzles, and the third nozzles are formed; the ink-jet printer may further include a wiper which is movable relative to the ink jetting surface in the second direction, and wipes the ink adhered to the ink jetting surface; and the third nozzle row may be positioned at a farthermost downstream side with respect to a direction in which the wiper moves while wiping the ink jetting surface. For example, when a special color ink which cannot be checked visually such as an ink which emits fluorescence upon reacting to the ultraviolet rays, or the magnetic ink, is flowed into a nozzle jetting the other ink, and is jetted upon being mixed with the other ink, it leads to a major problem when an image formed of the special color ink printed on a recording medium is to be detected by an appropriate device. Moreover, in a case in which the special color ink is an ink having a poor dispersibility, such as the white color ink, the gold ink, and the silver ink, which includes fine particles having a high specific gravity, when the special color ink is flowed into a nozzle which jets an ink of other type, it causes blocking of the nozzle. Whereas, in a case of the present invention, since the third nozzle row is positioned at the extreme downstream side with respect to the direction of movement of the wiper while wiping the ink jetting surface, an area near ejecting ports of the third nozzles in the ink jetting surface is wiped at the last. Therefore, it is possible to suppress the special color ink which has adhered to the ink jetting surface, from being flowed into a nozzle which jets other ink at the time of wiping.

In the ink-jet printer of the present invention, the ink-jet head may include an ink jetting surface in which ejecting ports of the first nozzles, the second nozzles, and the third nozzles are formed; the ink-jet printer may further include a wiper which is movable relative to the ink jetting surface in the second direction, and wipes the ink adhered to the ink jetting surface; and the third nozzle row may be positioned at a farther most downstream side with respect to a direction in which the wiper moves while wiping the ink jetting surface. In this case, since the third nozzle row is positioned at the extreme downstream side with respect to the direction of movement of the wiper while wiping the ink jetting surface, an area near ejecting ports of the third nozzles in the ink jetting surface is wiped at the last, Therefore, it is possible to suppress the special color ink which has a adhered to the ink jetting surface, from being flowed into a nozzle which jets other ink at the time of wiping.

The ink-jet printer of the present invention, may further include a maintenance mechanism which maintain the inkjet head, the maintenance mechanism including a cap which covers the ink-jet head, a suction mechanism which sucks the ink through the cap, and a wiper having flexibility. In this case, since the ink-jet printer includes the maintenance mechanism which performs maintenance such as performing a purge operation when there is a blockage of nozzle, or wiping ink etc. which is adhered near a nozzle of the ink-jet head, it is possible to maintain an ink-jetting condition of the ink-jet head to be satisfactory. Moreover, at the time of performing the purge operation, a possibility of the sucked ink getting adhered to the ink jetting surface of the ink-jet head is high. Even in this case, there is no possibility of the special color ink flowing into a nozzle jetting the other ink.

DETAILED DESCRIPTION OF THE PREFERRED EMBODIMENTS

Figure 1:
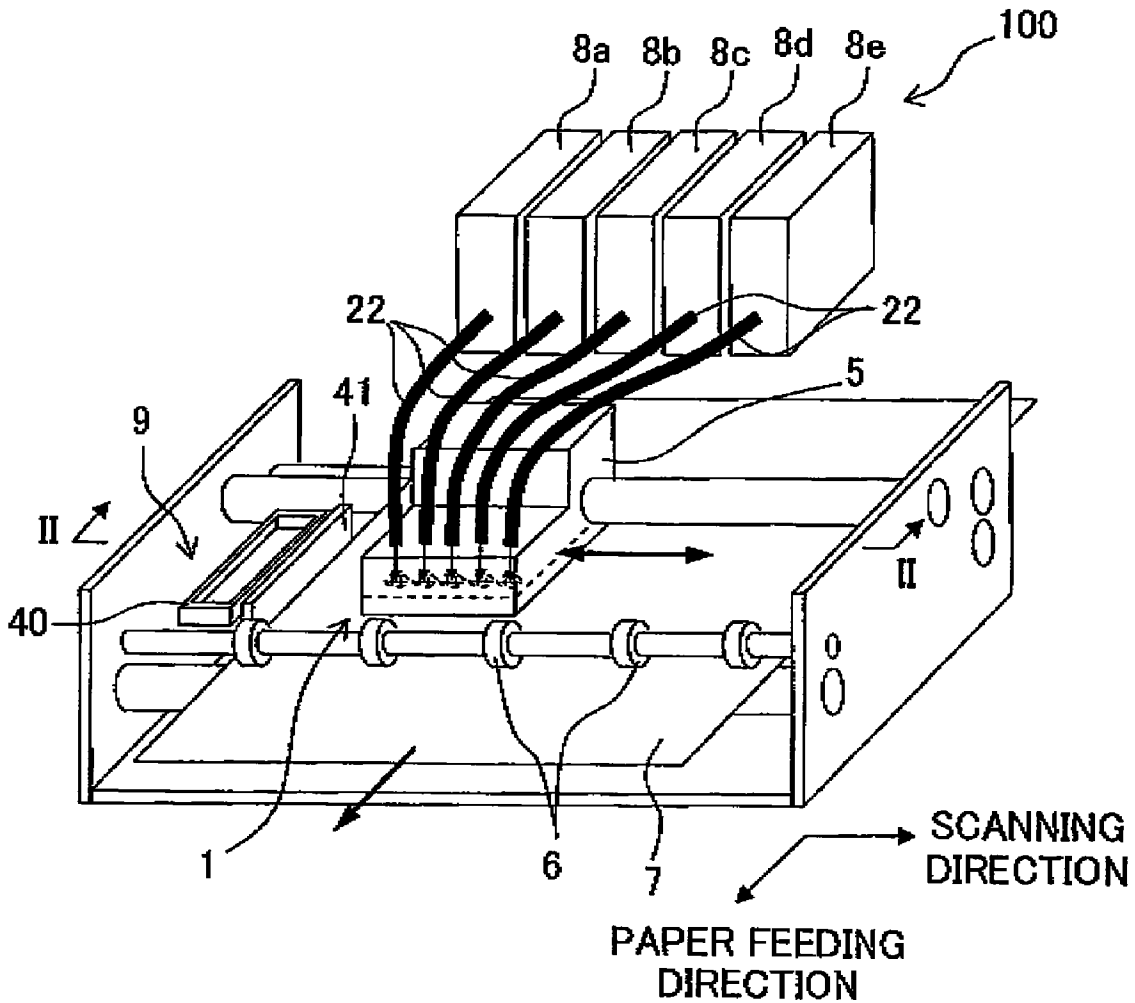
FIG. 1 is a schematic structural view of an ink-jet printer according to an embodiment of the present invention.

An embodiment of the present invention will be described below. This embodiment is an example in which the present invention is applied to a color ink-jet printer which jets inks of four colors (cyan, magenta, yellow, and black) from nozzles, on to a recording paper, Firstly, a schematic structure of an ink-jet printer 100 will be described below. As shown in FIG. 1, the ink-jet printer 100 includes a carriage 5 which is movable in a left and right direction in FIG. 1, an ink-jet head 1 of serial type which is provided on the carriage 5, and jets the ink on to a recording paper 7, and transporting rollers 6 which transport the recording paper 7 in a forward direction. The ink-jet head 1 is connected to five ink cartridges 8*a* to 8*e* via tubes 22. Here, a black ink is stored in the ink cartridge 8*b*, and color inks of three colors cyan, magenta, and yellow respectively are stored in the three ink cartridges 8*c* to 8*e*. Moreover, a special color ink is stored in the ink cartridge 8*a*. The special color ink is an ink other than the black ink and the color inks, and the special color ink corresponds to an ink which do not contribute to a formation of a full color image such as an ink which diffuses an aroma, or a gold ink and a silver ink, a white color ink, a transparent ink, and a fluorescent ink, and a special ink which reacts to ultraviolet rays or magnetism. In other words, in this embodiment, the special color inks do not include so called light color inks, which contribute to the formation of a full color image, such as light cyan and light magenta.

Moreover, this ink-jet printer 100, while transporting the recording paper 7 in a paper feeding direction (forward direction) by the transporting rollers 6, the ink-jet head 1 is moved integrally with the carriage 5 in a scanning direction (left and right direction), and by jetting five types of inks on to the recording paper 7 from ejecting ports 26 of nozzles 20 (refer to FIG. 3 to FIG. 6) formed in a lower surface (ink jetting surface 1*a*) of the ink-jet head 1, it is possible to record desired characters and image on the recording paper 7.

Figure 2:
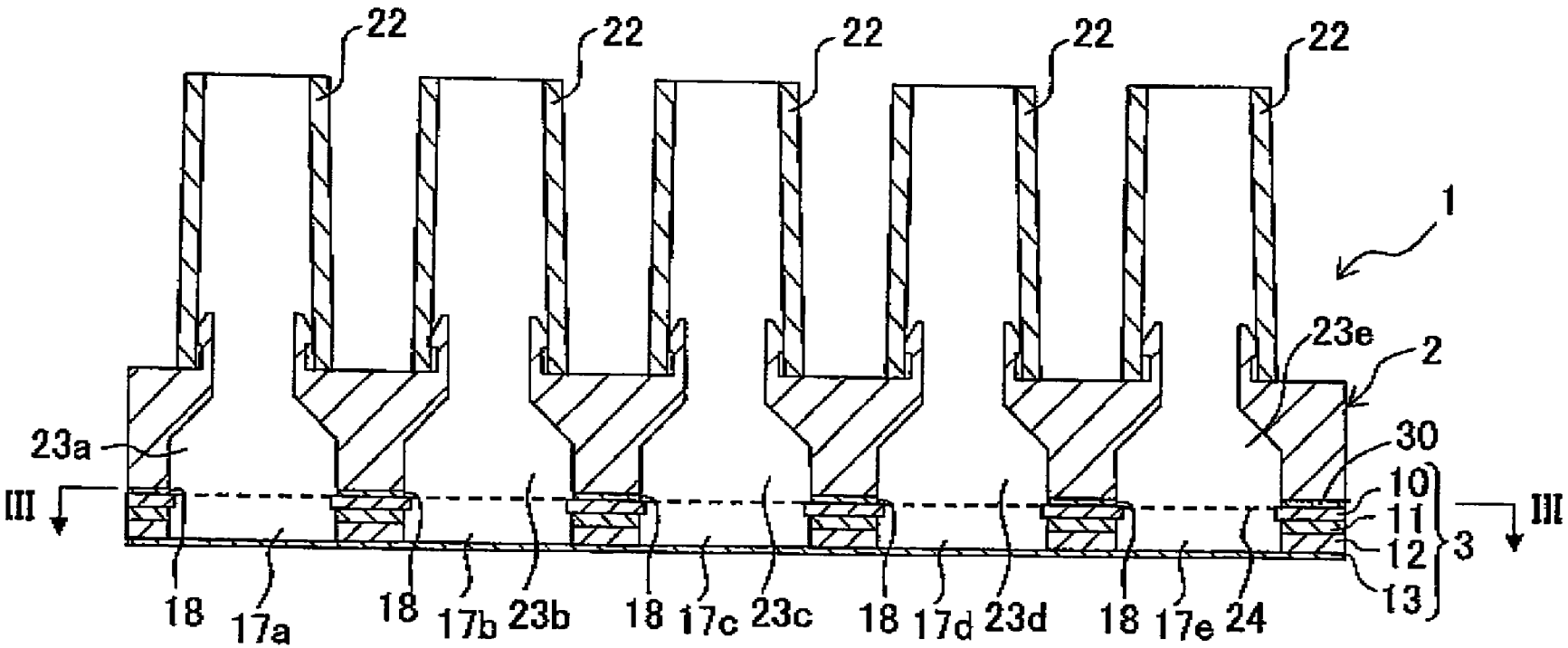
FIG. 2 is a cross-sectional view taken along a line II-II in FIG. 1.

Next, the ink-jet head 1 will be described below in detail by referring to FIG. 2 to FIG. 6. The ink-jet head 1 includes a reservoir unit 2 which is connected to the five ink cartridges 8*a* to 8*e* via the tubes 22, a channel unit 3 which is positioned at a lower side of the reservoir unit 2 and in which ink channels including the nozzles 20 and pressure chambers 14 are formed, and a piezoelectric actuator 4 which is positioned on an upper surface of the channel unit 3 and which applies a jetting pressure on ink in the pressure chamber 14, As shown in FIG. 2, inside the reservoir unit 2, five ink reservoirs 23*a* to 23*e* arranged in the scanning direction (left and right direction) are formed and the five tubes 22 are connected to these five ink-jet reservoirs 23*a* to 23*e*. Five types of inks (special color, black, cyan, magenta, and yellow) are supplied to the five ink reservoirs 23*a* to 23*e* from the five ink cartridges 8*a* to 8*e*, via the tubes 22. Moreover, a vibration plate 30 of the piezoelectric actuator 4 is positioned at a lower side of the reservoir unit 2, and five ink supply ports 18 formed in the vibration plate 30 communicate with a lower end of the five ink reservoirs 23*a* to 23*e*.

Figure 5:
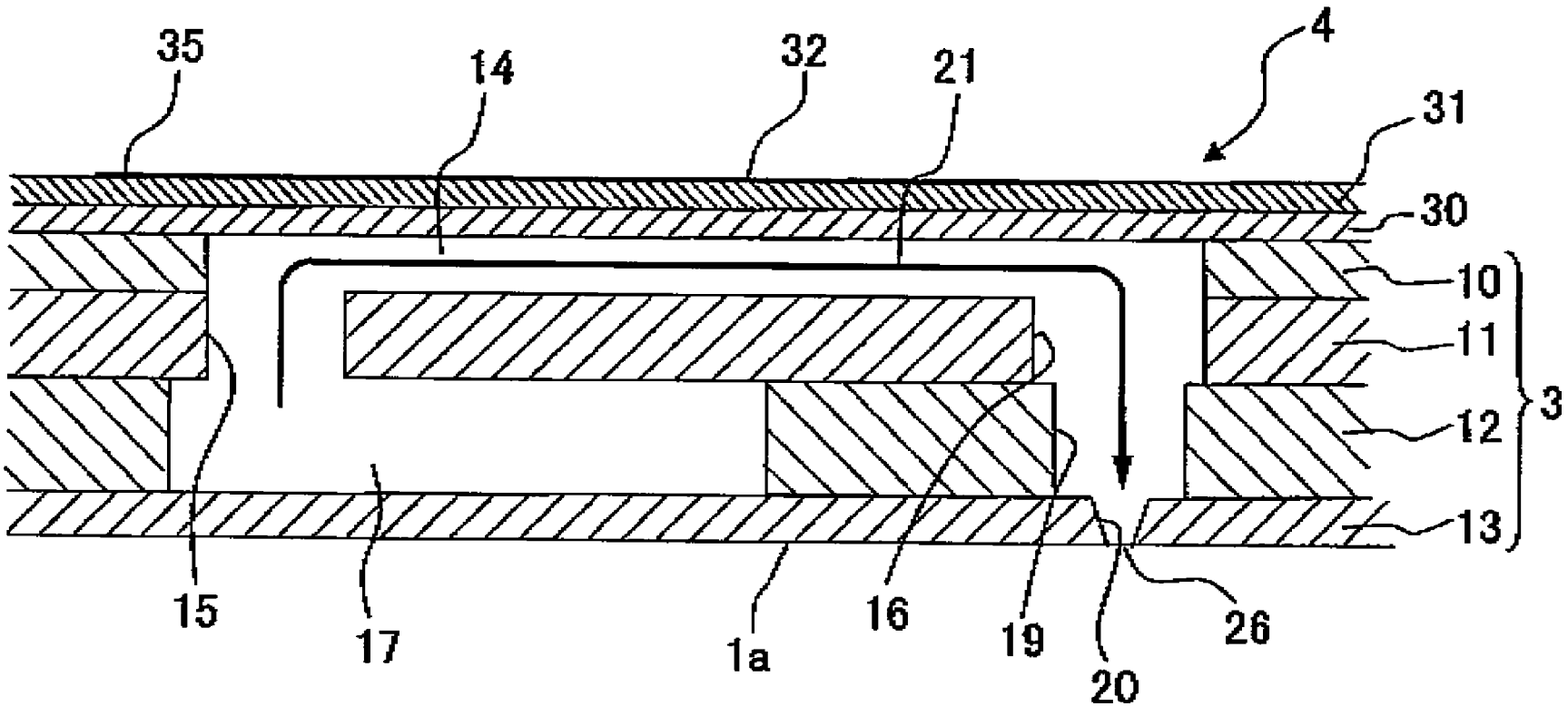
FIG. 5 is a cross-sectional view taken along a line V-V in FIG. 4.
Figure 6:
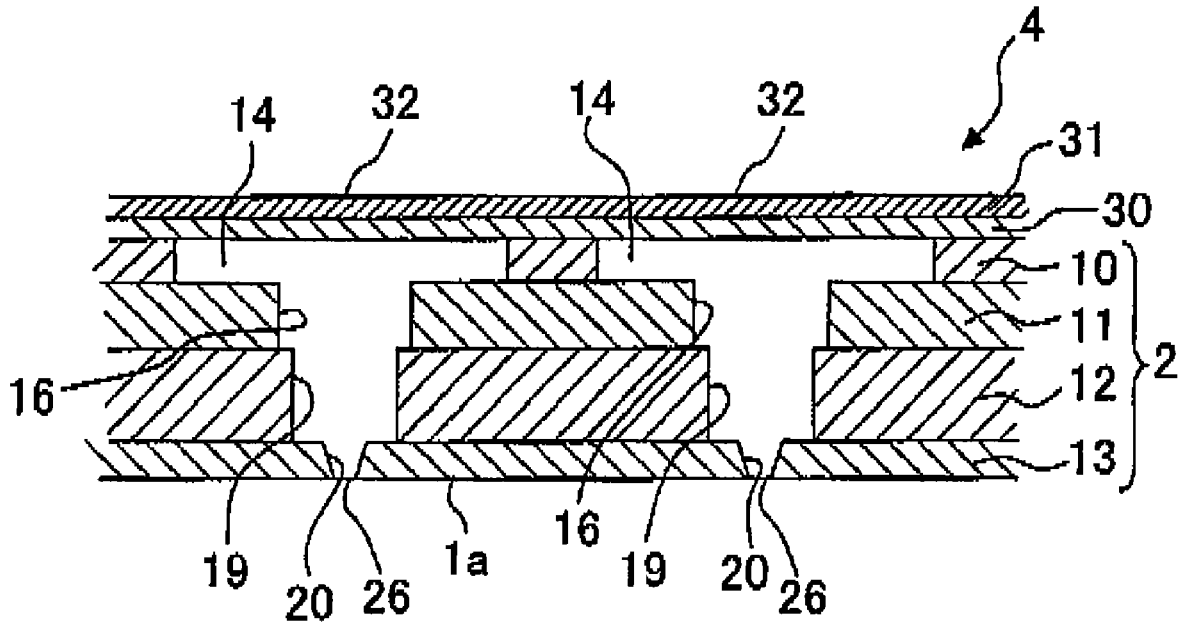
FIG. 6 is a cross-sectional view taken along a line VI-VI in FIG. 4.

As shown in FIGS. 2, 5 and 6, the channel unit 3 includes a cavity plate 10, a base plate 11, a manifold plate 12, and a nozzle plate 13, and these four plates 10 to 13 are joined in stacked layers in order from top to bottom. The cavity plate 10, the base plate 11, and the manifold plate 12 are plates made of stainless steel, and it is possible to form easily ink channels such as the pressure chamber 14 and a manifold 17 which will be described later, in these three plates 10 to 12. Moreover, the nozzle plate 13 is made of a high-molecular synthetic resin material such as polyimide for example, and is adhered to a lower surface of the manifold plate 12. The nozzle plate 13 may also be formed of a metallic material such as stainless steel, similar to the three plates 10-12.

As shown in FIGS. 3 to 6, a plurality of pressure chambers 14 arranged along a flat surface are formed as through holes in the cavity plate 10 which is positioned on a topmost side of the plates 10 to 13. These pressure chambers 14 are covered from both upper and lower sides by the base plate 11 and the vibration plate 30 of the piezoelectric actuator 4. Moreover, the pressure chambers 14 are arranged in five rows in the paper feeding direction (vertical direction in FIG. 3). Furthermore, each pressure chamber 14 is formed to be substantially elliptical in shape with a longitudinal axis in the scanning direction (left and right direction in FIG. 3).

Figure 3:
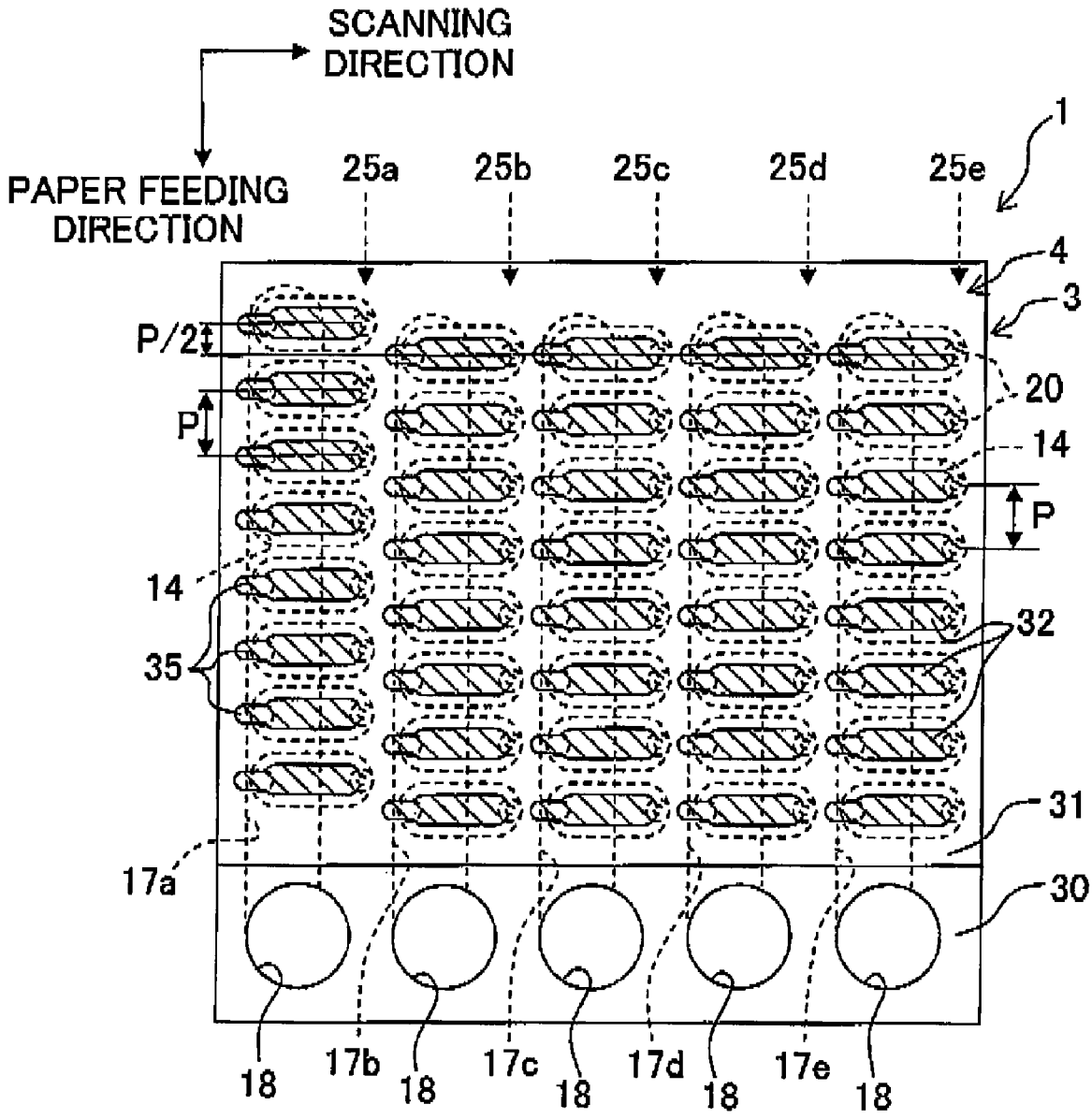
FIG. 3 is a plan view of an ink-jet head when viewed at a line III-III in FIG. 2.
Figure 4:
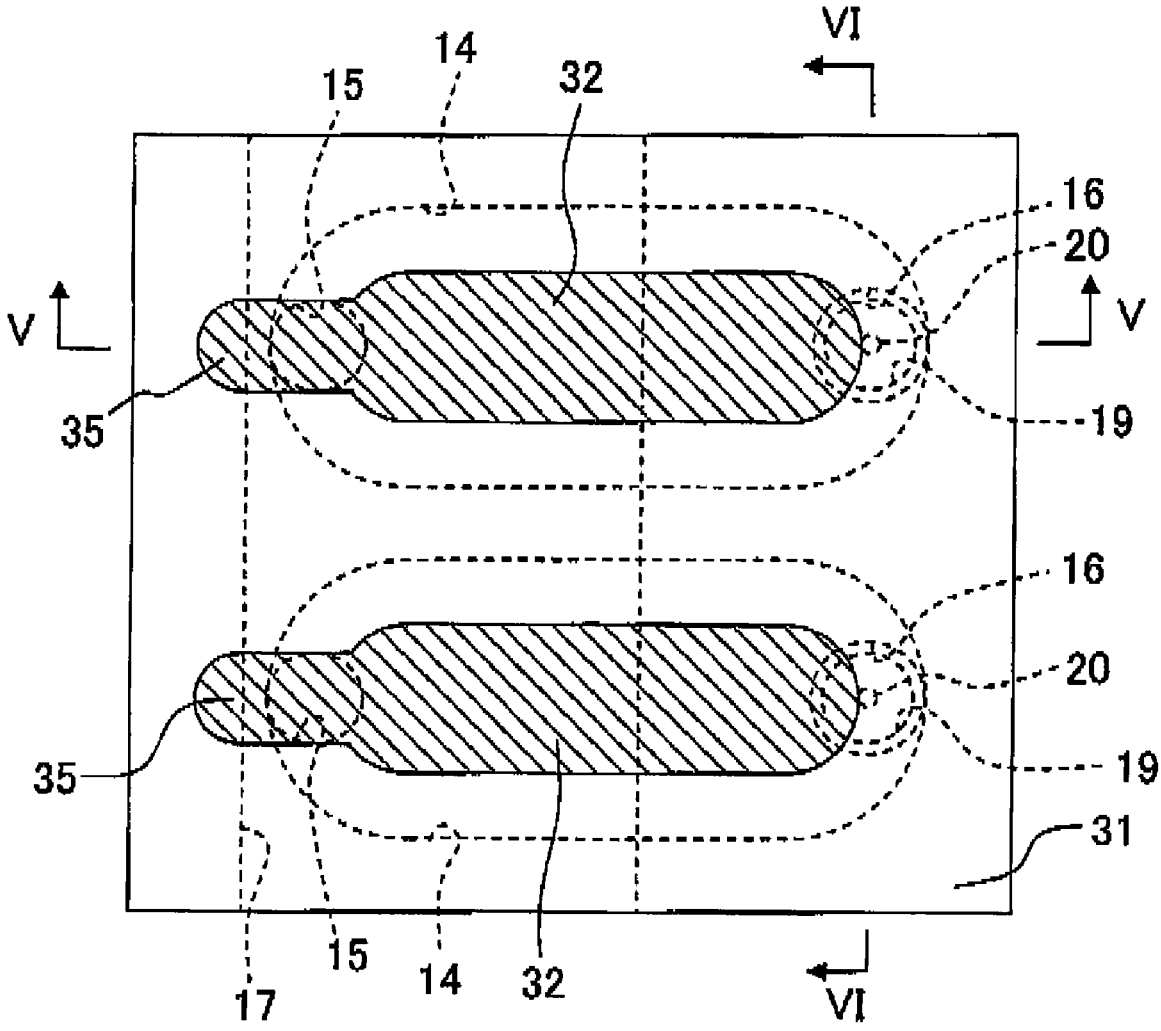
FIG. 4 is a partially enlarged view of FIG. 3.

Two communicating holes 15 and 16 are formed in the base plate 11, at positions overlapping with left and right end portions of each pressure chamber 14, in a plan view. Moreover, five manifolds 17 (17*a* to 17*e*) extended in the paper feeding direction (vertical direction in FIG. 3) are formed in the manifold plate 12. As shown in FIG. 3, these five manifolds 17*a* to 17*e* overlap with a left half portion of the pressure chambers 14 arranged in five rows, in a plan view. Furthermore, as shown in FIG. 2, the five manifolds 17*a* to 17*e* communicate with five ink supply ports 18 formed in the vibration plate 30, and five types of inks namely the special color, black, cyan, magenta, and yellow in order from a left side, are supplied from the five ink reservoirs 23*a* to 23*e* of the reservoir unit 2. Filters 24 which remove impurities such as dust etc. in the ink are provided between the five ink supply ports 18 of the vibration plate 30 and the manifolds 17*a* to 17*e*. Moreover, a plurality of communicating holes 19 which communicate with the communicating holes 16 respectively is formed in the manifold plate 12, at positions overlapping with right end portions (end portions on a side opposite to the manifold 17) of the pressure chambers 14 in a plan view.

The nozzles 20 are formed in the nozzle plate 13 at positions overlapping with the communicating holes 19 respectively in a plan view. As shown in FIG. 3, the nozzles 20 are arranged in an area overlapping with right end portions (end portions on the side opposite to the manifold 17) of the pressure chambers 14 arranged in five rows. In other words, the nozzles 20 are arranged in the paper feeding direction (vertical direction in FIG. 3: first direction) in an area not overlapping with five manifolds 17, and form five rows of nozzles (nozzle rows) 25*a* to 25*e* arranged in the scanning direction (second direction). Moreover, the ejecting ports 26 of the nozzles 20 are formed on a lower surface (ink jetting surface 1*a*) of the nozzle plate 13.

As shown in FIG. 5, the manifold 17 communicates with the pressure chamber 14 via the communicating hole 15, and further, the pressure chamber 14 communicates with the nozzle 20 via the communicating holes 16 and 19. Thus, in the channel unit 3, a plurality of individual ink channels 21 from the manifold 17 up to the five nozzle rows 25*a* to 25*e* via the pressure chambers 14 are formed, and a same type of ink flows to an individual ink channel (individual ink channel group) communicating with each manifold. In other words, in the channel unit 3, five types of individual ink channel groups through which five types of ink flow are formed. In FIG. 3, the black ink is supplied from the manifold 17*a* to the nozzles 20 (first nozzles) included in the nozzle row 25*b* (first nozzle row), and the color inks of three colors namely cyan, magenta, and yellow are supplied from the three manifolds 17*c* to 17*e* to the nozzles 20 (second nozzles) included in the three nozzle rows 25*c* to 25*e* (second rows of nozzles) on aright side thereof. On the other hand, the special color ink is supplied from the manifold 17*b* to the nozzles 20 (third nozzles) included in the nozzle row 25*a* (third nozzle row) positioned at an extreme left end.

As shown in FIG. 3, in the five nozzle rows 25*a* to 25*e*, a pitch P of nozzles 20 (distance between the two nozzles 20) for all nozzles is the same, and moreover, lengths of these nozzle rows 25*a* to 25*e* (in other words, the number of nozzles 20 forming the nozzle row: eight nozzles in FIG. 3) are also the same. Moreover, regarding the four nozzle rows 25*b* to 25*e* on a right side, a positions in the paper feeding direction of the nozzles 20 coincide (match) mutually, the nozzle row 25*a* on a left end is misaligned (shifted) toward an upstream side in the paper feeding direction (upper side in FIG. 3) by P/2 only, with respect to the other four nozzle rows 25*b* to 25*e*. The nozzle rows 25*a* to 25*e* are positioned at a same interval with respect to (in) the scanning direction.

Next, the piezoelectric actuator 4 will be described below. As shown in FIGS. 3 to 6, the piezoelectric actuator 4 includes the vibration plate 30 positioned on the upper surface of the channel unit 3, a piezoelectric layer 31 formed continuously over the pressure chambers 14, on an upper surface of the vibration plate 30, and a plurality of individual electrodes 32 formed on an upper surface of the piezoelectric layer 31, corresponding to the pressure chambers 14 respectively.

The vibration plate 30 is a metallic plate having a substantially rectangular shape. The vibration plate 30 is made of a material such as an iron alloy like stainless steel, a copper alloy, a nickel alloy, or a titanium alloy. The vibration plate 30 is arranged on an upper surface of the cavity plate 10 so as to cover the pressure chambers 14, and is joined to the cavity plate 10. Moreover, the vibration plate 30 is positioned facing the individual electrodes 32, and is kept all the time at a ground electric potential. Therefore, the vibration plate 30 also functions as a common electrode which generates an electric field in a direction of thickness in the piezoelectric layer between the individual electrodes 32 and the vibration plate 30.

The piezoelectric layer 31 which is composed of mainly lead zirconate titanate (PZT) which is a solid solution of lead titanate and lead zirconate, and is a ferroelectric substance is formed on the upper surface of the vibration plate 30. This piezoelectric layer 31 is formed continuously over the pressure chambers 14. The piezoelectric layer 31 can be formed by an aerosol deposition (AD method) in which ultra fine particlate material is deposited by allowing to collide at a high speed. Apart from this, a sol-gel method, a sputtering method, a hydrothermal synthesis method, or a chemical vapor deposition (CVD method) can also be used. Furthermore, the piezoelectric layer 31 can also be formed by adhering on a surface of the vibration plate 30 a piezoelectric sheet which is obtained by baking a green sheet of PZT.

The individual electrodes 32 having a substantially elliptical shape slightly smaller than the pressure chamber 14, are formed on the upper surface of the piezoelectric layer 31, corresponding to the pressure chambers 14. The individual electrodes 32 are formed at positions overlapping with a central portion of the corresponding pressure chamber 14, in a plan view. The individual electrode 32 is made of an electroconductive material such as gold, copper, silver, palladium, platinum, or titanium. Furthermore, a plurality of contact points 35 is drawn from one end portion (end portion toward a manifold 17) of the individual electrodes 32 in a major axis direction of the individual electrodes 32 respectively. Contact points of a wiring member (omitted in the diagram) having a flexibility, such as a flexible printed circuit (FPC) are connected to these contact points 35. The contact points 35 are electrically connected to a driving circuit (omitted in the diagram) which selectively supplies a drive voltage to the individual electrodes 32 via the wiring member. The individual electrodes 32 and the contact points 35 can be formed by a method such as a screen printing, a sputtering method, or a vapor deposition.

Next an action of the piezoelectric actuator 4 at the time of jetting the ink will be described below. When the drive voltage is selectively applied from the driving circuit to the individual electrodes 32, an electric potential of the individual electrodes 32 to which the drive voltage is applied and an electric potential of the vibration plate 30 as the common electrode, which is kept at the ground electric potential, differ. Therefore, an electric field in a direction of thickness is generated in the piezoelectric layer 31 sandwiched between the individual electrode 32 and the vibration plate 30. Here, when a direction in which the piezoelectric layer 31 is polarized and a direction of the electric field are the same, the piezoelectric layer 31 is elongated in the direction of thickness which is the direction in which the piezoelectric layer 31 is polarized, and is contracted in a horizontal direction. With this contracted deformation of the piezoelectric layer 31, since the vibration plate 30 is deformed to be projected toward the pressure chamber 14, a volume in the pressure chamber 14 is decreased. When the volume in the pressure chamber 14 is decreased, a pressure is applied to the ink in the pressure chamber 14, and a droplet of ink is jetted from the nozzle 20 which communicates with the pressure chamber 14.

Incidentally, as it has been described above, the nozzle rows 25*a* to 25*e* shown in FIG. 3 communicate with the manifolds 17*a* to 17*e* via the pressure chambers 14. Five types of inks are supplied to the manifolds 17*a* to 17*e* respectively. The black ink is jetted from the nozzle 20 included in the nozzle row 25*b*, and color inks of three colors (cyan, magenta, and yellow) are jetted from the nozzles 20 included in the nozzle rows 25*c* to 25*e*. On the other hand, the special color ink is jetted from the nozzle 20 included in the nozzle row 25*a* positioned at the extreme left side.

In other words, in the ink-jet head of the present invention, it is possible to jet further the special color ink, which do not contribute to the full color printing, in addition to the black ink, and the color ink which contributes to the full color printing. Therefore, the ink-jet head 1 can deal with (handle) the printing of variety of images. Moreover, since five types of inks can be jetted from one head, it is possible to narrow an interval between the five nozzle rows 25*a* to 25*e*, as compared to a case in which five heads which jet five types of inks are provided. Furthermore, since it is also possible to shorten a length of the ink-jet head 1 in the scanning direction, it is possible to reduce a size of the ink-jet printer 100. Moreover, the nozzles 20 are arranged in the paper feeding direction, and the nozzle rows 25*a* to 25*e* are arranged in the scanning direction. Since these two directions are mutually orthogonal, it is possible to suppress to the minimum an increase in the length of the ink-jet head 1 in the scanning direction due to providing the nozzle row 25*a* for the special color ink.

Moreover, when the special ink is an ink having a poor dispersibility, such as the white color ink, the gold ink and the silver ink, which includes fine particles having a high specific gravity, when this special color ink is flowed into the nozzle 20 which jets the other ink, the fine particles are precipitated inside the nozzle 20, and there is a possibility of occurrence of a jetting defect such as a nozzle blocking. Even when the special color ink is white ink, since the ink contains titanium oxide which has a high specific gravity, there is a possibility of occurrence of the jetting defect in a similar way. However, in the ink-jet head 1 in this embodiment, as shown in FIG. 3, since the nozzle row 25*a* jetting the special color ink is positioned at an extreme end (left end) with respect to the scanning direction, a possibility of the special color ink mixing with the other ink on the ink jetting surface 1*a* is low. Consequently, an occurrence of the jetting defect in the nozzle 20 due to the flowing of the special color ink into the nozzle 20 jetting the other ink is suppressed.

On the other hand, the nozzle row 25*b* jetting the black ink and the nozzle rows 25*c* to 25*e* jetting the color inks are positioned closely. Therefore, at the time of full color printing, a landing position of the black ink jetted from the nozzle row 25*b* and a landing position of the color inks jetted from the nozzle rows 25*c* to 25*e* respectively are hardly shifted, and a printing quality is improved. Furthermore, all the position of the nozzle 20 included in these nozzle rows 25*b* to 25*e*, with respect to the paper feeding direction coincide. Therefore, when the ink-jet head 1 is moved in the scanning direction once, it is possible to make the black ink and the color ink to land at the same position on the recording paper 7. Consequently, a difference in time of landing of the black ink and the color inks becomes small, and unevenness in color is suppressed, and the printing quality is further improved.

Furthermore, the ink-jet printer 100 in this embodiment, includes a maintenance mechanism 9 which restores a jetting condition of the nozzle 20 when a jetting defect has occurred in any nozzle 20 of the ink-jet head 1. This maintenance mechanism 9 is capable of performing a nozzle purge when the ink-jet head is at a stand-by position to which the ink-jet head 1 has retracted to an outer side in a direction of width (left side in FIG. 1) farther than a transporting route of the recording paper 7. The nozzle purge means to discharge the ink forcibly from the nozzle 20 having a jetting defect.

As shown in FIGS. 1 and 7, the maintenance mechanism 9 includes a purge cap 40 provided to be movable vertically, to a base 42 which is positioned at a left side of the transporting route of the recording paper 7, and a wiper 41 which is provided to be movable vertically, to the base 42, and positioned at a right side of the purge cap 40. In FIG. 7, positions of the nozzle rows 25*a* to 25*e* of the ink-jet head 1 with respect to the scanning direction are shown by alternate long and short dash lines respectively.

Figure 7A:
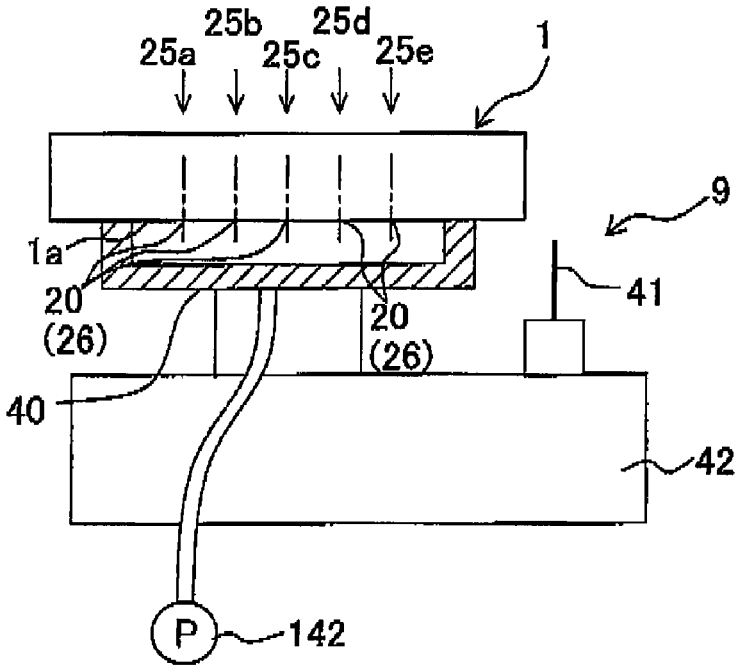
FIG. 7A is a diagram describing an operation of a maintenance mechanism, in which a state at a time of nozzle purge is shown.

The purge cap 40 is capable of moving vertically, and can move to a purge position (FIG. 7A) which makes a contact with the ink jetting surface 1*a* and which covers the ejecting port 26 of the nozzle 20, and a purge preparation position (FIG. 7B) which does not make a contact with the ink jetting surface 1*a*. Moreover, a suction pump 142 is connected to this purge cap 40. When a jetting defect is occurred in a certain nozzle 20, the purge cap 40 moves from the purge preparation position to the purge position, and makes a contact with the ink jetting surface 1*a* covering the ejecting port 26 of the nozzle 20 as shown in FIG. 7A. Next, in this state, a space formed inside the purge cap 40 is vacuumed up by the suction pump 142, and the ink inside the nozzle 20 with the jetting defect is discharged forcibly to the space inside the purge cap 40.

Figure 7B:
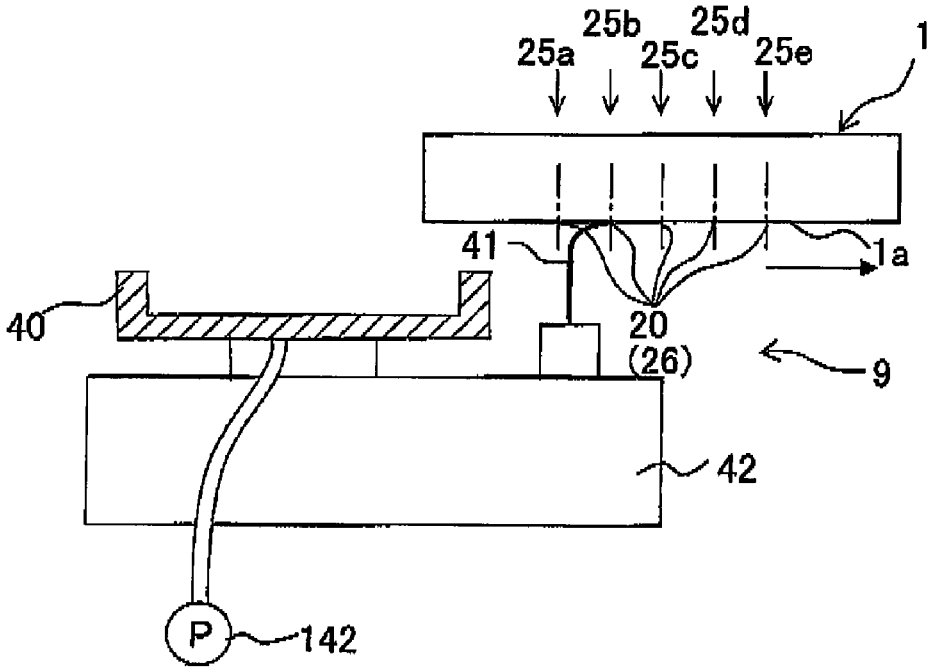
FIG. 7B is a diagram showing the operation of the maintenance mechanism, in which a state at a time of wiping is shown.

The wiper 41 is made of a flexible material such as a synthetic resin material or a rubber material. An upper end (front end) of the wiper is a free end, and a lower end is fixed to the base 42. Moreover, the wiper 41 is capable of moving vertically, and the front end of the wiper 41 can be moved to a ready position (FIG. 7A) (at) which (the wiper 41) does not make a contact with the ink jetting surface 1*a*, and a wiping position (FIG. 7B) (at) which (the wiper 41) makes a contact with the ink jetting surface. As shown in FIG. 7A, when the ink-jet head 1 is moved to the stand-by position for performing the nozzle purge described above, the wiper 41 is at the ready position and does not make a contact with the ink jetting surface 1*a* of the ink-jet head 1 which moves. On the other hand, after the nozzle purge is over, the wiper 41 is moved from the ready position to the wiping position, and the front end of the wiper 41 makes a contact with the ink jetting surface 1*a*. In this state, as shown in FIG. 7B, when the ink-jet head 1 moves toward right, Since the wiper 41 moves toward left relatively with the ink jetting surface 1*a*, the ink adhered to the ink jetting surface 1*a* at the time of the nozzle purge is wiped by the wiper 41.

Here, the nozzle row 25*a* jetting the special color ink of the ink-jet head 1 is positioned at the extreme left end with respect to the scanning direction. In other words, since the wiper moves relatively to the left with respect to the ink jetting surface 1*a*, the nozzle row 25*a* is positioned at the extreme downstream side with respect to the direction of movement. Therefore, as shown in FIG. 7B, an area of the ink jetting surface 1*a*, near the ejecting port 26 of the nozzle 20 jetting the special color ink is wiped at the last by the wiper 41. Consequently, the special color ink adhered to the ink jetting surface 1*a* is suppressed from being flowed into the nozzle 20 jetting other ink at the time of wiping.

In the ink-jet head 1 of this embodiment, when the special color ink is not used, it is possible to make the black ink be jetted instead of the special color ink from the nozzle row 25*a* which basically jets the special color ink, according to a judgment of a user. In this case, since the black ink is jetted simultaneously from the two nozzle rows 25*a* and 25*b* which are shifted by P/2 in the paper feeding direction, the printing speed is increased than a printing speed in a case of performing a monochrome printing only by one nozzle row 25*b*. In this case, it is necessary to replace the special color ink in the reservoir unit 2 and the channel unit 3 by the black ink, and it is possible to replace the color ink by the black ink by the following method.

Firstly, the ink cartridge 8*a* (refer to FIG. 1) of the special color ink is removed, and the special color ink in the ink reservoir 23*a* positioned at the extreme left of the reservoir unit 2, and the manifold 17*a* (refer to FIG. 2) of the channel unit 3 communicating with this ink reservoir 23*a* is discharged by sucking from an upstream side (opposite side of the nozzle 20), by a suction unit such as a pump. Next, a cartridge for cleaning which supplies a cleaning liquid is connected to the tube 22, and the cleaning liquid is filled in the manifold 17*a* from the ink reservoir 23*a* of the reservoir unit 2. After this, by the maintenance mechanism 9, the special color ink remained in the ink reservoir 23*a*, the manifold 17*a*, and the individual ink channel 21 is discharged forcibly by the cleaning liquid, from nozzle 20 included in the nozzle row 25*a*. Next, after removing the cartridge for cleaning, the ink cartridge 8*b* of the black ink is connected to the ink reservoir 23*a* of the reservoir unit 2 by the tube 22, and the black is filled into an ink channel from the ink reservoir 23*a* up to the nozzles 20 included in the nozzle row 25*a*.

In a case of performing the printing by the special color ink once again, the black ink in the reservoir unit 2 and the channel unit 3 may be replaced by the special color ink in the same manner as described above.

Next, modified embodiments in which various modifications are made in the embodiment, will be described below. Same reference numerals are used for components having a structure same as in the embodiment and description of such components is omitted.

First Modified Embodiment

In the ink-jet printer 100 in the first embodiment, the user can determine and change the type of ink to be jetted from the nozzle row 25*a* (whether to jet the special color ink or the black ink). However, the ink which can be jetted from the nozzle row 25*a* may be determined at a manufacturing stage of the printer. In other words, whether the printer is to be a printer capable of jetting the special color ink from the nozzle row 25*a*, or a printer capable of a high-speed black and white printing (monochrome printer), jetting the black ink from both the nozzle rows 25*a* and 25*b* may be determined (at the manufacturing stage).

Figure 8:
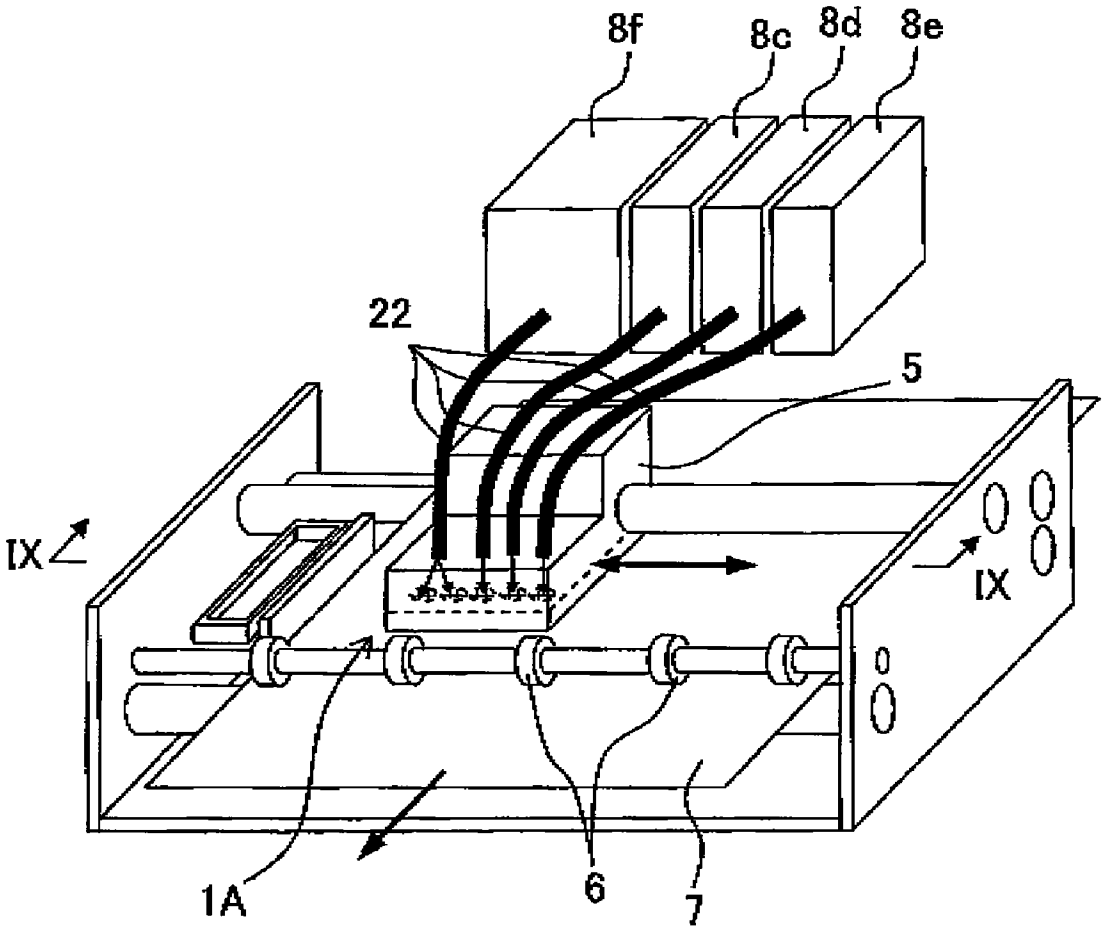
FIG. 8 is schematic structural view of an ink-jet printer of a first modified embodiment.

Here, the nozzle row 25*a* which is capable of jetting the special color ink, is positioned adjacent to the nozzle row 25*b* which jets the black ink. Therefore, in a case of manufacturing a printer which is capable of the high-speed monochrome printing, it is possible to provide commonly a portion which supplies the black ink to each of the two nozzle rows 25*a* and 25*b*, and to simplify a structure of the printer. In other words, as shown in FIG. 8, it is possible to supply the ink to each of the two nozzle rows 25*a* and 25*b*, from an ink cartridge 8*f* which stores the black ink.

Figure 9:
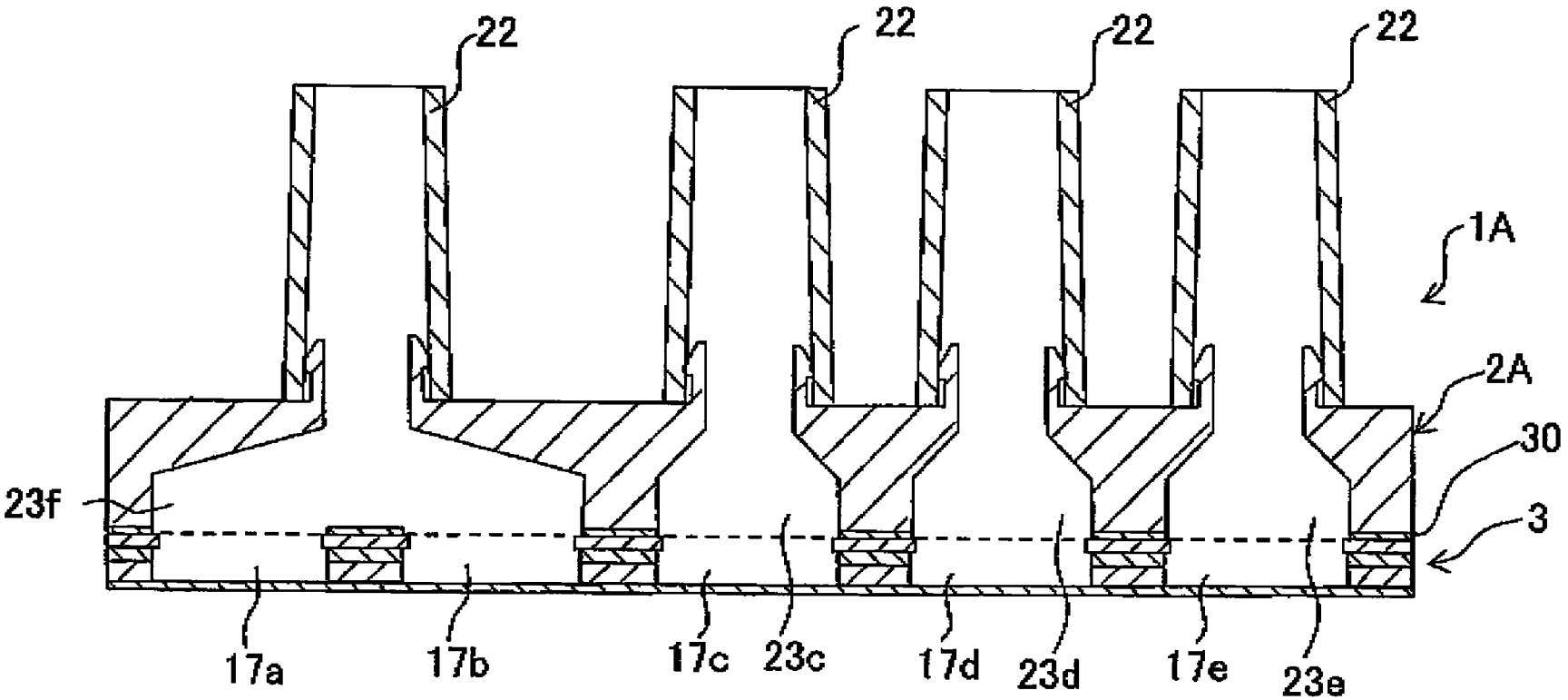
FIG. 9 is a cross-sectional view taken along a line IX-IX in FIG. 8.

In an ink-jet head 1A in a first modified embodiment, as compared to the ink-jet head 1 in the embodiment, structure of the channel unit 3 and the piezoelectric actuator 4 is the same, but a structure of a reservoir unit is slightly different. As shown in FIG. 9, a reservoir unit 2A in the first modified embodiment includes four ink reservoirs 23*f*, 23*c*, 23*d*, and 23*e* arranged in a left and right direction. The ink reservoir 23*f* positioned at an extreme left side is connected to the ink cartridge 8*f* which stores the black ink, via the tube 22, and further communicates with the two manifolds 17*a* and 17*b* communicating with the nozzle rows 25*a* and 25*b* respectively, of the channel unit 3. Consequently, the black ink stored in the ink cartridge 8*f* is supplied to each of the nozzles 25*a* and 25*b* via the common ink reservoir 23*f*.

Second Modified Embodiment

Figure 10:
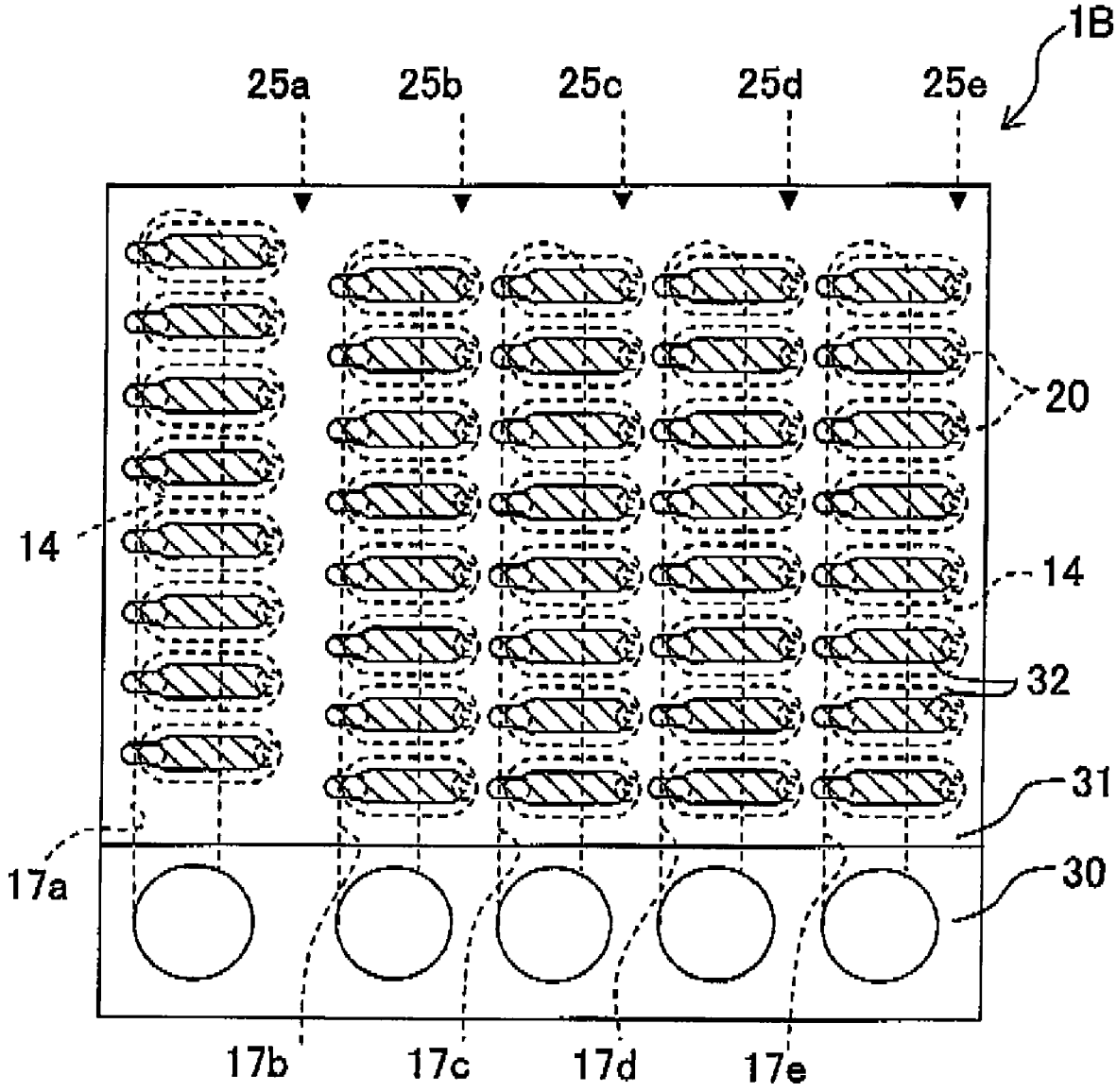
FIG. 10 is a plan view corresponding to FIG. 3, of a second modified embodiment.

In the embodiment, the five nozzle rows 25*a* to 25*e* are positioned at the same interval with respect to the scanning direction (refer to FIG. 2). However, as shown in an ink-jet head 1B shown in FIG. 10, an interval between the nozzle row 25*a* jetting the special color ink and the nozzle row 25*b* jetting the black ink may be longer than an interval between the four nozzle rows 25*b* to 25*e*. In this structure, the special color ink jetted from the nozzle row 25*a* is prevented assuredly from flowing into the nozzle 20 jetting the other ink.

Third Modified Embodiment

Figure 11:
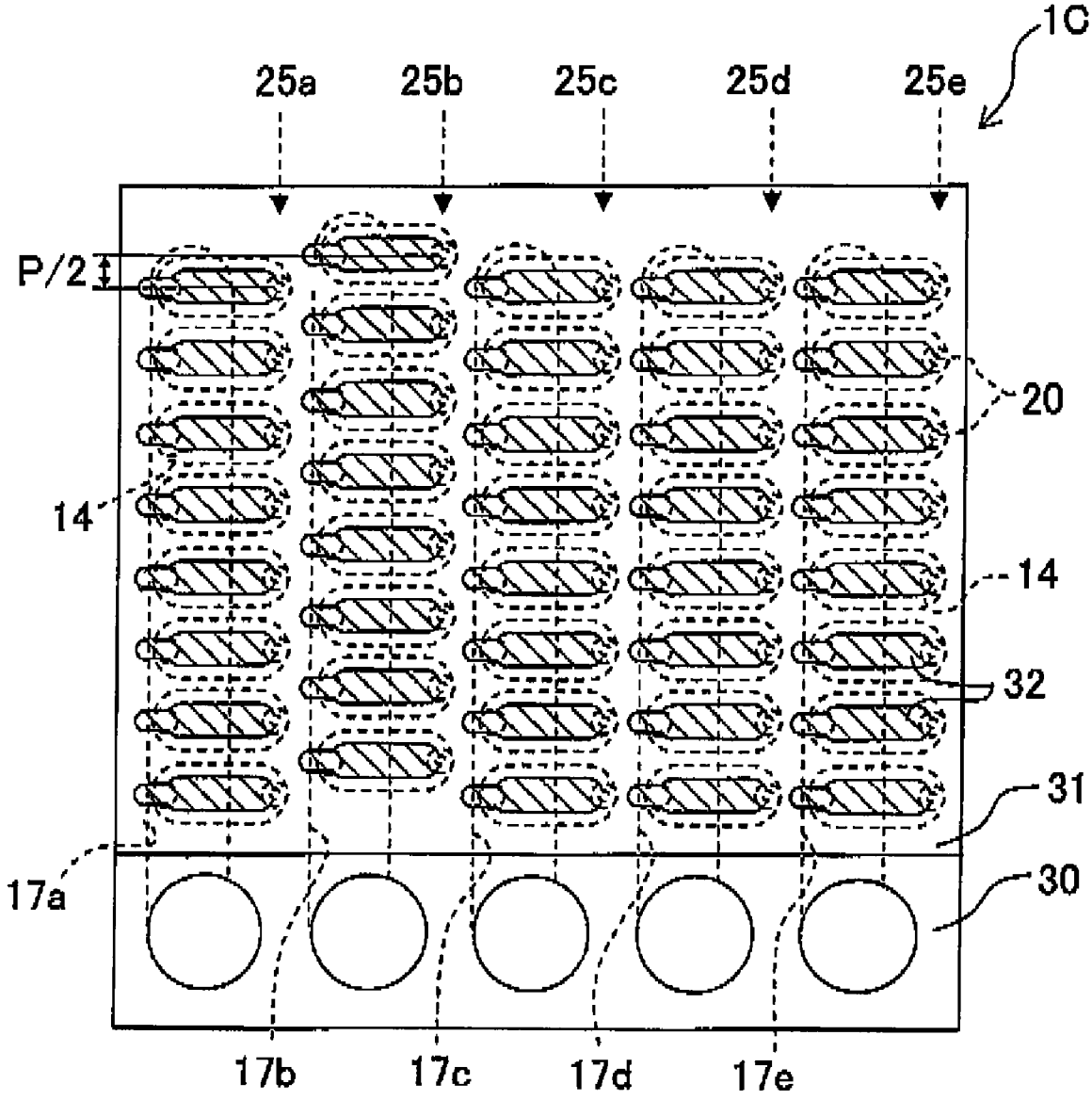
FIG. 11 is a plan view corresponding to FIG. 3, of a third modified embodiment.

As in an ink-jet head 1C shown in FIG. 11, the positions of nozzles 20 belonging to four nozzle rows, which include the nozzle rows 25*c* to 25*e* for the color inks of three colors, and the nozzle row 25*a* for the special color ink with respect to the paper feeding direction may be aligned, and the nozzle row 25*b* for the black ink may be misaligned (shifted) by only P/2 in the paper feeding direction, with respect to the four nozzle rows 25*a*, and 25*c* to 25*e*. In this case, when the black ink is made to be jetted also from the nozzle row 25*a* for the special color ink, the black ink is jetted simultaneously from the nozzle rows 25*a* and 25*b* shifted only by P/2 in the paper feeding direction. Therefore, the printing speed is increased than a speed in the case of performing the monochrome printing only by the nozzle row 25*b*.

Fourth Modified Embodiment

Figure 12:
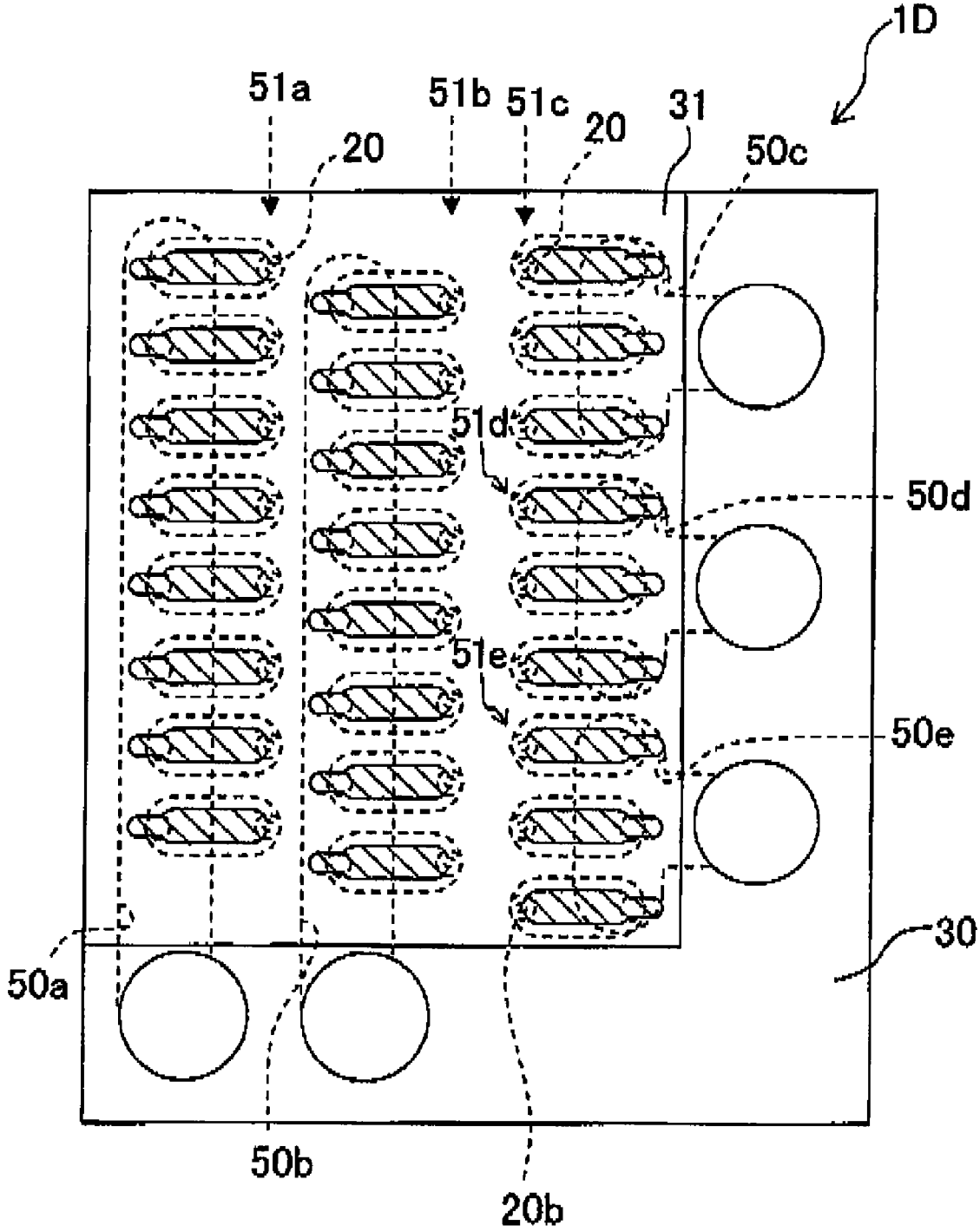
FIG. 12 is a plan view corresponding to FIG. 3, of a fourth modified embodiment.

As in an ink-jet head 1D shown in FIG. 12, each of a manifold 50*a* and a nozzle row 51*a* for the special color ink, and a manifold 50*b* and a nozzle row 51*b* for the black color ink may be extended in the paper feeding direction, and three manifolds 50*c* to 50*e* to which color ink of three colors are supplied respectively may be arranged in the paper feeding direction, and the three types of nozzles 20 (nozzle rows 51*c* to 5*e*) communicating with the three manifolds 50*c* to 50*e* respectively may be arranged in one line in the paper feeding direction.

Fifth Modified Embodiment

Figure 13:
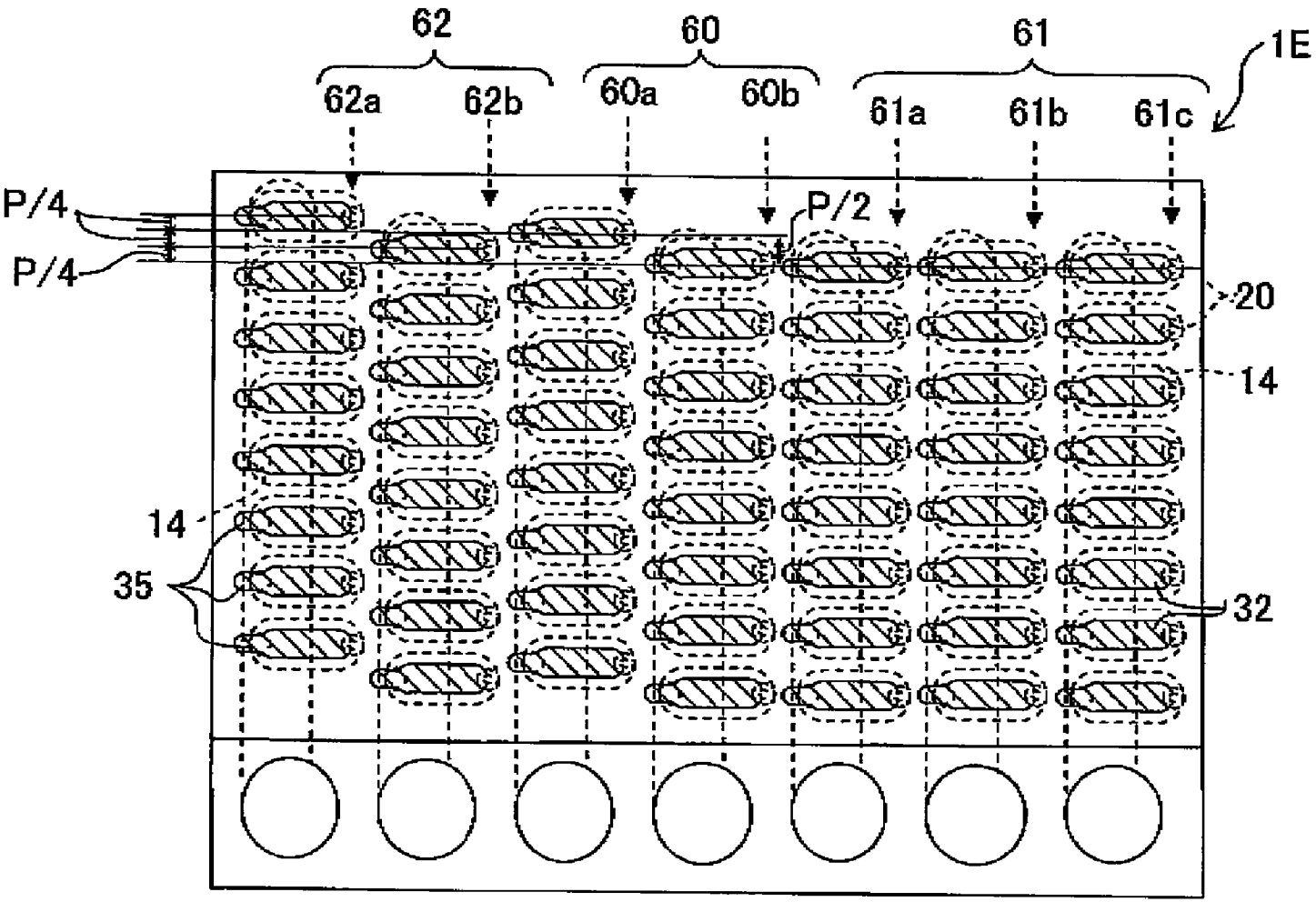
FIG. 13 is a plan view corresponding to FIG. 3, of a fifth modified embodiment.

A plurality of nozzle rows jetting the black ink and/or a plurality of nozzle rows jetting the special color ink may be provided. For example, an ink-jet head 1E shown in FIG. 13 includes a nozzle row group 60 (first nozzle row group) which includes the nozzles 20 jetting the black ink, a nozzle row group 61 (second nozzle row group) which includes the nozzles 20 jetting color inks of three colors, and a nozzle row group 62 (third nozzle row group) which includes the nozzles 20 jetting the special color ink.

Moreover, each nozzle row group includes a plurality of nozzle rows including the same number of nozzles 20 arranged at pitch P (eight nozzles in FIG. 13) in the paper feeding direction. In other words, the nozzle row group 60 which jets the black ink includes two nozzle rows 60*a* and 60*b* (first nozzle sub array) which are mutually adjacent, and the nozzle row 60*a* on a left side is shifted with respect to the nozzle row 60*b* on a right side by P/2 toward a down stream side in the paper feeding direction. Moreover, the nozzle row group 61 which jets the color ink includes nozzle rows 61*a*, 61*b*, and 61*c* (second nozzle sub array) jetting color inks of three types respectively, and in these three nozzle rows 61*a* to 61*c*, positions of the nozzles 20 in the paper feeding direction, included in each nozzle row coincide mutually, and further, are the same positions as the nozzle 20 included in the nozzle row 60*b* on the right side for the black ink. The nozzle row group 62 which jets the special color ink includes two nozzle rows 62*a* and 62*b* (third nozzle sub array) which are mutually adjacent, and the nozzle row 62*a* on the left side is shifted with respect to the nozzle row 62*b* on the right side, by only P/2 toward the upstream side in the paper feeding direction. Moreover, these two nozzle rows 62*a* and 62*b* are positioned upon being shifted with respect to the nozzle rows 60*a* and 60*b*, by only P/4 toward the upstream side in the paper feeding direction (upper side in FIG. 12). Moreover, the three nozzle row groups 60 to 62 are positioned to be arranged in the scanning direction, and further, the nozzle row group 62 jetting the special color ink is positioned at an extreme end (left end) in the scanning direction.

In this case, in the nozzle row group 60 which jets the black ink and the nozzle row group 62 which jets the special color ink, since the interval between the nozzles (pitch) in the scanning direction is P/2, the printing speed at the time of performing the printing by the black ink and the special color ink is increased. Moreover, when the black ink is made to be jetted also from the nozzles 20 of the nozzle row group 62 for the special color ink, in addition to the nozzles 20 of the nozzle row group 60, the pitch of the nozzles 20 jetting the black ink becomes P/4. Consequently, the printing speed in the monochrome printing in increased.

Moreover, the nozzle row group 62 which jets the special color ink is positioned at the extreme left end in the scanning direction. In other words, the nozzle row group 62 is positioned at an extreme downstream side in a direction of relative movement of the wiper 41 (refer to FIG. 7), with respect to the ink jetting surface. Therefore, an area around the ejecting ports 26 of the nozzles 20 included in the nozzle row group 62 which jet the special color ink is wiped at the last by the wiper 41. Consequently, even in this ink-jet head 1E, at the time of wiping, the special color ink adhered to the ink jetting surface during a nozzle purge is suppressed from flowing into the nozzle 20 which jets the other ink.

In the embodiment, a direction of arrangement (first direction) of the nozzles 20 is orthogonal to the paper feeding direction (second direction) which is a direction in which the nozzle rows are arranged (refer to FIG. 3). However, the direction of arrangement of the nozzles 20 may intersect the scanning direction at an angle other than 90°, and an effect substantially similar to an effect in the embodiment is achieved provided that at least these two directions are not parallel mutually.

The ink-jet head in the embodiment described above is an ink-jet head of serial type which jets ink on to a recording paper while moving in a direction of width of the recording paper. However, the present invention is also applicable to an ink-jet head of line type, which includes a plurality of nozzle rows extended across the entire width of the recording paper. Furthermore, the present invention is not restricted to the ink-jet head which records an image etc. on the recording paper, and is also applicable to an ink-jet head which records (an image etc.) on various recording media such as a cloth, a textile fabric, and a metal plate.

What is claimed is:

1. An ink-jet head which jets an ink onto a medium, comprising:

a plurality of independent manifolds, each independent manifold configured to store the ink;

a first nozzle row including a plurality of first nozzles which are arranged in a first direction and which jet a black ink;

a second nozzle row including a plurality of second nozzles which are arranged in the first direction and which jet a color ink contributing to a full color printing; and a third nozzle row including a plurality of third nozzles which are arranged in the first direction and which jet a special color ink which is an ink other than the black ink and the color ink, wherein the first nozzle row, the second nozzle row, and the third nozzle row are aligned in a second direction which intersects with the first direction, and the third nozzle row is arranged at an end with respect to the second direction, the first nozzle row comprises two first nozzle sub arrays, wherein the first nozzles in each first nozzle sub array are aligned in the first direction at the pitch P, and the two first nozzle sub arrays are shifted by P/2 in the first direction, the second nozzle row comprises a plurality of second nozzle sub arrays, each second nozzle sub array comprising a predetermined number of the second nozzles arranged in the first direction at the pitch P, the second nozzles belonging to each of the second nozzle sub arrays are aligned in the first direction, and the color ink includes a plurality of sub color inks which are different in color, and each of which is jetted from second nozzles belonging to one of the second nozzle sub arrays, the third nozzle row comprises two third nozzle sub arrays, each third nozzle sub array comprising a predetermined number of third nozzles aligned in the first direction at the pitch P, and the two third nozzle sub arrays are shifted by P/4 in the first direction with respect to the first nozzle sub array, the first nozzle row, the second nozzle row, and the third nozzle row are aligned in the second direction which intersects with the first direction, and the third nozzle row is positioned at a furthermost end in the second direction, and the manifolds are configured to be in fluid communication with the first, second, and third nozzle sub arrays respectively, and each of the manifolds is configured to be in fluid communication with one of the first, second, or third nozzle sub arrays.

2. The ink-jet head according to claim 1, wherein the third nozzle row is positioned next to the first nozzle row.

3. The ink-jet head according to claim 1, wherein the first nozzles and the second nozzles are positioned at same positions with respect to the first direction.

4. The ink-jet head according to claim 1, wherein the first direction is orthogonal to the second direction.

5. The ink-jet head according to claim 1, wherein the special color ink is an ink which is selected from a group consisting of a gold ink, a silver ink, a white ink, a transparent ink, an aromatic ink, a fluorescent ink, an ultraviolet fluorescent ink, and a magnetic ink.

6. An ink-jet printer comprising an ink-jet head which jets an ink, the ink jet head comprising:

a plurality of independent manifolds, each independent manifold configured to store the ink;

a first nozzle row including a plurality of first nozzles which are arranged in a first direction and which jet a black ink;

a second nozzle row including a plurality of second nozzles which are arranged in the first direction and which jet a color ink contributing to a full color printing; and a third nozzle row including a plurality of third nozzles which are arranged in the first direction and which jet a special color ink which is an ink other than the black ink and the color ink, wherein the first nozzle row, the second nozzle row, and the third nozzle row are aligned in a second direction which intersects with the first direction, and the third nozzle row is arranged at an end with respect to the second direction, the first nozzle row comprises two first nozzle sub arrays, wherein the first nozzles in each first nozzle sub array are aligned in the first direction at the pitch P, and the two first nozzle sub arrays are shifted by P/2 in the first direction, the second nozzle row comprises a plurality of second nozzle sub arrays, each second nozzle sub array comprising a predetermined number of the second nozzles arranged in the first direction at the pitch P, the second nozzles belonging to each of the second nozzle sub arrays are aligned in the first direction, and the color ink includes a plurality of sub color inks which are different in color, and each of which is jetted from second nozzles belonging to one of the second nozzle sub arrays, the third nozzle row comprises two third nozzle sub arrays, each third nozzle sub array comprising a predetermined number of third nozzles aligned in the first direction at the pitch P, and the two third nozzle sub arrays are shifted by P/4 in the first direction with respect to the first nozzle sub array, the first nozzle row, the second nozzle row, and the third nozzle row are aligned in the second direction which intersects with the first direction, and the third nozzle row is positioned at an end in the second direction, and the manifolds are configured to be in fluid communication with the first, second, and third nozzle sub arrays respectively, and each of the manifolds is configured to be in fluid communication with one of the first, second, or third nozzle sub arrays.

7. The ink-jet printer according to claim 6, wherein the ink-jet head includes an ink jetting surface in which ejecting ports of the first nozzles, the second nozzles, and the third nozzles are formed; the ink-jet printer further comprises a wiper which is movable relative to the ink jetting surface in the second direction, and wipes the ink adhered to the ink jetting surface; and the third nozzle row is positioned at a farthermost downstream side with respect to a direction in which the wiper moves while wiping the ink jetting surface.

8. The ink-jet printer according to claim 6, further comprising a maintenance mechanism which maintain the inkjet head, the maintenance mechanism including a cap which covers the ink-jet head, a suction mechanism which sucks the ink through the cap, and a wiper having flexibility.

* * * * *